US006793333B2

(12) United States Patent
Brignone et al.

(10) Patent No.: US 6,793,333 B2
(45) Date of Patent: Sep. 21, 2004

(54) INK RECEIVING SHEET

(75) Inventors: Diego Brignone, Carcare (IT); Paola Franceschini, Cairo Montenotte (IT); Andrea Gagliardo, Cosseria (IT); Giovanni Maria Manca, Cairo Montenotte (IT)

(73) Assignee: Ferrania, S.p.A., Ferrania (IT)

( * ) Notice: Subject to any disclaimer, the term of this patent is extended or adjusted under 35 U.S.C. 154(b) by 0 days.

(21) Appl. No.: 10/441,606

(22) Filed: May 20, 2003

(65) Prior Publication Data

US 2003/0222963 A1 Dec. 4, 2003

(30) Foreign Application Priority Data

May 21, 2002 (IT) ..... SV2002A0023

(51) Int. Cl.[7] ..... B41J 2/01
(52) U.S. Cl. ..... 347/105; 428/32.1; 428/195
(58) Field of Search ..... 347/105, 101, 347/100; 428/195, 32.1

(56) References Cited

U.S. PATENT DOCUMENTS

| | | | | | |
|---|---|---|---|---|---|
| 4,503,111 | A | | 3/1985 | Jaeger et al. | 428/195 |
| 5,621,448 | A | | 4/1997 | Oelbrandt et al. | 347/96 |
| 5,621,449 | A | | 4/1997 | Leenders et al. | 347/101 |
| 5,759,673 | A | | 6/1998 | Ikezawa et al. | 428/198 |
| 6,059,404 | A | | 5/2000 | Jaeger et al. | 347/88 |
| 6,066,387 | A | * | 5/2000 | Ueda et al. | 428/195 |
| 6,110,585 | A | * | 8/2000 | Shaw-Klein | 347/105 |
| 6,137,563 | A | * | 10/2000 | Agano | 355/405 |
| 6,152,616 | A | * | 11/2000 | Torisawa | 396/575 |
| 6,341,855 | B1 | | 1/2002 | Kurabayashi | 347/100 |
| 6,342,096 | B1 | | 1/2002 | Kurabayashi | 106/31.27 |
| 6,534,157 | B1 | * | 3/2003 | Baker et al. | 428/195 |
| 6,634,743 | B2 | * | 10/2003 | Perchak et al. | 347/101 |

FOREIGN PATENT DOCUMENTS

| | | | |
|---|---|---|---|
| EP | 0 947 350 A1 | 10/1999 | B41M/5/00 |
| EP | 0 987 119 A1 | 3/2000 | B41M/5/00 |
| WO | WO 97/17207 | 5/1997 | B41M/5/00 |

* cited by examiner

*Primary Examiner*—Stephen D. Meier
*Assistant Examiner*—Manish Shah
(74) *Attorney, Agent, or Firm*—Mark A. Litman & Associates

(57) ABSTRACT

An ink receiving sheet includes a support, at least one receiving layer and a top coat layer. The receiving layer includes a hydrophilic binder and a vinyl polymeric compound and has a total coverage weight of at least 12 g/m$^2$. The top coat layer is free of vinyl polymeric compounds and includes a hydrophilic binder and a corn starch matting agent.

10 Claims, No Drawings

INK RECEIVING SHEET

BACKGROUND OF THE INVENTION

1. Field of the Invention

The present invention relates to a receiving sheet for ink-jet printing. More particularly, the present invention relates to an ink receiving sheet comprising a corn starch matt agent and adapted to be used with a concentrated ink, especially for obtaining medical images showing high optical density.

2. Background of the Art

In a typical ink jet recording or printing system, ink droplets are ejected from a nozzle at high speed towards a recording element or medium to produce an image on the recording medium. The ink droplets, toner, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-recording layer. The recording elements may include either those intended for reflection viewing, which have an opaque support, or those intended for viewing by transmitted light, which have a transparent support.

Medical images, such as radiographic images, are typically viewed on a blue transparent support and require a high optical density, i.e., usually higher than 3.00. Medical images of such a high optical density are typically obtained by means of silver technology, in which the image is formed by exposing a light-sensitive silver salt and the subsequent formation of black silver by development (reduction) of the light-sensitized silver salt.

The progress and development of the ink-jet technology and the relative costs between the silver technology and ink-jet imaging have increased the demand for obtaining medical images with the ink-jet technology.

However, ink jet technology involves a problem unique to the technology. When high-density printing is conducted on a transparent recording medium, the desired maximum optical density to be produced in the ink-jet image is hard to achieve compared with the available optical density of an image obtained with the silver salt method. This is a result of the high transparency of the coloring material.

U.S. Pat. No. 6,342,096, 6,341,855 and 6,059,404 attempt to solve this problem of low maximum optical densities by providing an ink-jet recording method using a mix of different inks printed on a receiving sheet that is adapted to receive such different inks. This solution has proved expensive and has not led to good results.

U.S. Pat. No. 5,621,448 and 5,621,449 attempt to solve this ink-jet density problem with a combination of the silver and ink-jet technologies. U.S. Pat. No. 5,621,448 discloses a recording method comprising the consecutive steps of: (1) image-wise projecting droplets of liquid, called ink, containing halide ions, onto a receiving material containing at least one substantially light-insensitive silver salt. The ink and/or receiving material contains at least one reducing agent for the silver salt, (2) uniformly photo-exposing the receiving material to form silver nuclei from silver halide obtained in step (1), and (3) heating the receiving material during and/or after the photo-exposure step. This forms a silver image in correspondence with the area wherein the ink has been deposited on the receiving material. U.S. Pat. No. 5,621,449 discloses an ink jet recording method comprising the steps of: (1) image-wise projecting liquid, called ink, in the form of droplets onto a receiving material. The receiving material contains a substance that, by chemically reacting with another substance contained in said droplets, is capable of forming a visually detectable product. The process is characterized in that according to a first mode, the receiving material contains at least one substantially light-insensitive organic silver salt and the ink contains a reducing agent for the silver salt, and according to a second mode, the receiving material contains the reducing agent and the ink contains the silver salt, and optionally (2) heating the receiving material during and/or after the deposition of the ink on the receiving material to start or enhance reduction of the silver salt(s) forming thereby image-wise a deposit of silver metal in the receiving material. This solution to obtaining higher density ink-jet images is still expensive and requires special apparatus and several steps in order to get the desired images.

U.S. Pat. No. 4,503,111 discloses an ink-jet receiving sheet comprising a support coated with an ink receiving layer. The support, consisting of a transparent base sheet, such as cellulose acetate or polyethylene terephthalate, is coated with a mixture of polyvinylpyrrolidone and a compatible matrix-forming polymer, such as gelatin or polyvinyl alcohol. The sheet is disclosed to be used in ink jet printers and in pen-type graphics recorders to record large color-filled areas with high color density and excellent resolution.

SUMMARY OF THE INVENTION

An ink receiving sheet comprises a support, at least one receiving layer and a top coat layer, The receiving layer comprises a hydrophilic binder and a vinyl polymeric compound and has a total coverage weight of at least 12 g/m$^2$. The top coat layer is free of vinyl polymeric compounds and comprises a hydrophilic binder and a corn starch matting agent.

DETAILED DESCRIPTION OF THE INVENTION

The ink receiving sheet comprises a transparent support, at least one ink receiving layer and a top coat layer. The transparent support used in the ink receiving sheet of the invention may include any transparent film and especially includes polymeric films such as films of polyester resins, cellulose acetate resins, acrylic resins, polycarbonate resins, polysulfone resins, polyvinyl chloride resins, poly (vinylacetal)resins, polyether resins, polysulfonamide resins, polyamide resins, polyimide resins, acetate resins (e.g., cellulose triacetate), cellophane or celluloid and glass plates. The thickness of the transparent support is preferably from 10 to 200 $\mu$m.

A subbing or primer layer to improve the adhesion between the support and the ink receiving layer(s) optionally may be provided. Several subbing layers for this purpose are widely known in the photographic art and include, for example, polymers or copolymers of vinylidene chloride such as vinylidene chloride/acrylonitrile/acrylic acid terpolymers or vinylidene chloride/methyl acrylate/itaconic acid terpolymers. A further adhesion layer of hydrophilic binder can be coated as first layer before coating the ink receiving layer.

The ink receiving layer mainly comprises a hydrophylic binder and at least one vinyl polymeric compound. The ink receiving layer may optionally comprise several other components. Useful components are represented by filters, surfactants, hardeners, plasticizers, antistatic agents and the like. The ink receiving layer has a total coverage weight of at least 12 g/m$^2$, preferably of at least 15 g/m$^2$.

The top coat layer mainly comprises a hydrophilic binder and a corn starch matting agent. The top coat layer may optionally comprise several other components. Useful components are represented by surfactants, hardeners, antistatic agents, ultraviolet radiation absorbers and plasticizers. The top coat layer is substantially free or free of vinyl polymers or vinyl polymeric compounds.

The polymeric binder employed in the top coat layer and in the ink-receiving layer may include any useful hydrophilic polymer, either natural or synthetic. Useful hydrophilic polymers include acidified starch, ether derivatized starch, polyalkylene glycols (such as polyethylene glycol and polypropylene glycol), cellulose derivatives (such as hydroxyethyl cellulose, hydroxypropyl cellulose, hydroxyethylmethyl cellulose, hydroxypropylmethyl cellulose, hydroxybutylmethyl cellulose, methyl cellulose, sodium carboxymethyl cellulose, sodium carboxymethylhydroxethyl cellulose, ethylhydroxyethyl cellulose, cellulose sulfate), gelatin, gelatin derivatives, carrageenan, dextran, dextrin, gum arabic, casein, pectin, albumin, collagen derivatives, collodion, agar-agar, maleic acid resins, coniugate diene copolymer latexes such as styrene-butadiene resin and methylmethacrylate-butadiene copolymer and acrylic copolymer latexes such as a polymers or co-polymers of acrylic acid ester and methacrylic acid ester. These binders may be used independently or two or more thereof maybe used in combination.

Preferred binders are gelatin, gelatin derivatives, dextran or binary and ternary blends thereof Gelatin and gelatin derivatives are the particularly preferred materials for use in forming the ink receiving layer according to this invention. Among the reasons is the fact that they form a clear coating, are readily cross-linked in an easily controllable manner, and are highly absorptive of water-based liquid inks to thereby provide rapid-drying characteristics.

Any gelatin made from animal collagen can be used, but gelatin made from pig skin, cow skin or cow bone collagen is preferable. The kind of gelatin is not specifically limited, but lime-processed gelatin, acid processed gelatin, amino group inactivating gelatin (such as acetylated gelatin, phthaloylated gelatin, malenoylated gelatin, benzoylated gelatin, succinoylated gelatin, methyl urea gelatin, phenylcarbamoylated gelatin, and carboxy modified gelatin), or other gelatin derivatives (for example, gelatin derivatives disclosed in Japanese Patent Publication Nos. 38-4854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and British Patent Nos. 861,414 and 103,189) can be used singly or in combination.

The binder ordinarily makes up from 20 to 60 weight % and preferably 30 to 50 weight % based on the total solids weight content of the ink receiving layer. The ink receiving layer has a binder total coverage weight of at least 4.5 g/m$^2$, preferably of at least 5.5 g/m$^2$, more preferably up to a maximum total coverage weight of 25 g/m$^2$.

The binder resins ordinarily make up from 40 to 80 weight % and preferably 50 to 70 weight % based on the total solids weight content of the top coat layer. The top coat layer has a binder total coverage weight of from 0.1 to 1 g/m$^2$, preferably of from 0.3 to 0.7 g/m$^2$, more preferably up to a maximum total coverage weight of 1.5 g/m$^2$.

The corn starch matting agents employed in the top coat layer show an average particle size of less than 30 $\mu$m, preferably less than 20 ∞m, and more preferably of from 10 to 20 $\mu$m.

The corn starch matting agent ordinarily makes up from 10 to 50 weight % and preferably 15 to 35 weight % based on the total solids weight content of the top coat layer. The top coat layer has a corn starch matting agent total coverage weight of at least 0.1 g/m$^2$, preferably of at least 0.2 g/m$^2$, and more preferably from 0.1 to 0.4 g/m$^2$, preferably with a maximum total coverage weight of 1.5 g/m$^2$.

The vinyl polymeric compound used in the ink-jet receiving layer may include homopolymers and copolymers of vinyl alcohols, vinyl acetates, vinylpyrrolidones (such as N-vinyl-2-pyrrolidone), vinyllactams (such as N-vinylcaprolactam, N-vinyl-4-methylcaprolactam, N-vinyl-6-methyl-caprolactam, N-vinyl-6-propylcaprolactam and N-vinyl-7-butylcaprolactam) vinylimidazoles (such as N-vinyl-2-imidazole), and vinylpiperidones (such as N-vinyl-5-piperidone, N-vinyl-4-methylpiperidone, N-vinyl-4-propylpiperidone, N-vinyl-4-butylpiperidone, N-vinyl-6-butylpiperidone). Particularly useful vinyl polymeric compounds include polyvinylpyrrolidones and their copolymers with vinylcaprolactames and vinylpiperidones. Specific examples of vinyl polymeric compounds useful in the present invention are represented by copolymers of vinylpyrrolidone and vinylimidazole (such as Luvitec™ VPI55, sold by Basf AG, Germany), copolymers of vinylpyrrolidone and vinylcaprolactam (such as Luvitec™ VPC55, sold by Basf AG, Germany), and polymers of vinylcaprolactam (such as Luvitec™ VCAP, sold by Basf AG, Germany).

The vinyl polymeric compound(s) in the ink-jet receiving layer ordinarily make up from 30 to 70 weight % and preferably 40 to 60 weight % based on the total solids weight content of the ink receiving layer. The ink receiving layer has a vinyl polymeric compound total coverage weight of at least 7.5 g/m$^2$, preferably of at least 9.5 g/m$^2$, up to a maximum coverage weight of 50.0 g/m$^2$. The top coat layer must be free of vinyl polymeric compounds. By the wording "top coat layer is free of vinyl polymeric compounds" is meant that top coat layer may comprise less than 0.1 weight %, preferably less than 0.01 weight % of vinyl polymeric compounds.

As filler, inorganic and/or organic particles can be used. Useful examples of inorganic fillers are represented by silica (colloidal silica), metal oxides, alumina or alumina hydrate (aluminazol, colloidal alumina, a cationic aluminum oxide or its hydrate and pseudo-boehmite), a surface-processed cation colloidal silica, aluminum silicate, magnesium silicate, magnesium carbonate, titanium dioxide, zinc oxide, calcium carbonate, kaoline, talc, clay, calcium sulfate, barium sulfate, zinc sulfate, zinc carbonate, satin white, diatomaceous earth, synthetic amorphous silica, aluminum hydroxide, lithopone, zeolite, magnesium hydroxide and synthetic mica. Of these inorganic pigments, porous inorganic pigments are preferable such as porous synthetic crystalloid silica, porous calcium carbonate and porous alumina.

Useful examples of organic fillers are represented by polymeric materials, such as polystyrene, polymethacrylate, polymethyl-methacrylate, ethylene-vinyl acetate copolymers, polyesters, polyester-copolymers, polyacrylates, polyvinylethers, polyamides, polyolefines, polysilicones, guanamine resins, polytetrafluoroethylene, elastomeric styrene-butadiene rubber (SBR), elastomeric butadiene-acrylonitrile rubber (NBR), urea resins, urea-formalin resins. Such organic fillers may by used in combination, and/or in place of the above-mentioned inorganic fillers.

The ink receiving layer comprises less than 5 weight % of the above-described inorganic and/or organic fillers, and preferably less than 1 weight % based on the solid content of the ink receiving layer.

Preferred examples of surfactants used in the top coat layer and in the the ink-receiving layer include, amphoteric surfactants, cationic surfactants, and nonionic surfactants.

Particularly useful examples of the cationic surfactant include lauryl dimethyl aminoacetic acid betaine, 2-alkyl-N-carboxymethyl-N-hydroxyethyl imidazolinium betaine, propyldimethylaminoacetic acid betaine, polyoctyl polyaminoethyl glycine, and imidazoline derivatives.

Particularly useful examples of non-ionic surfactants include non-ionic fluorinated surfactants and non-ionic hydrocarbon surfactants. Particularly useful examples of non-ionic hydrocarbon surfactants include ethers, such as polyoxyethylene nonyl phenyl ether, polyoxyethylene octyl phenyl ether, polyoxyethylene dodecyl phenyl ether, polyoxyethylene alkyl allyl ethers, polyoxyethylene oleyl ethers, polyoxyethylene lauryl ethers, polyoxyethylene alkyl ethers, polyoxyalkylene alkyl ethers; esters, such as polyoxyethylene oleate, polyoxyethylene distearate, sorbitan laurate, sorbitan monostearate, sorbitan monooleate, sorbitan sesquioleate, polyoxyethylene mono-oleate and polyoxyethylene stearate; and glycol surfactants. Specific examples of nonionic surfactants include octyl-phenoxy polyethoxy ethanols, such as Triton™ X-100, X-114 and X-405, available from Union Carbide Co., Danbury, Conn.; acetylenic diols such as 2,4,7,9-tetramethyl-5-decyl-4,7-diol and the like, such as Surfynol™ GA and Surfynol™ CT-136, available from Air Products & Chemicals Co., Allentown, Pa.; trimethyl nonylpolyethylene-glycol ethers, such as Tergitol™ TMN-10 (containing 10 oxyethylene units, believed to be of formula $C_{12}H_{25}SO(C_2H_4O)_5H$), available from Union Carbide Co., Danbury, Conn. Non-limiting examples of non-ionic fluorinated surfactants include linear perfluorinated polyethoxylated alcohols (e.g., Zonyl™FSN, Zonyl™FSN-100, Zonyl™FSN-300, Zonyl™FSO, and Zonyl™FSO-100 available from DuPont Specialty Chemicals, Wilmington, Del.), fluorinated alkyl polyoxyethylene ethanols (e.g., Fluorad™ FC-170C available from 3M, St. Paul, Minn.), fluorinated alkyl alkoxylate (e.g., Fluorad™ FC-171 available from 3M, St. Paul, Minn.), fluorinated alkyl esters (e.g., Fluorad™ FC-430, FC-431, and FC-740 available from 3M, St. Paul, Minn.) and fluorine-substituted alkyl esters and perfluoroalkyl carboxylates (for example, the F-tergent™ series manufactured by Neos Co., Ltd., the Lodyne™ series manufactured by Ciba-Geigy, the Monflor™ series manufactured by ICI, the Surfluon™ series manufactured by Asahi Glass Co., Ltd., and the Unidyne™ series manufactured by Daikin Industries, Ltd.). Preferred nonionic fluorocarbon surfactants include Zonyl™ FSO, Fluorad™ FC-170C, and Fluorad™ FC-171.

The top coat layer and the ink receiving layer each comprises less than 5 weight % of the above-described surfactants, and preferably less than 1 weight % based on the solid content of the ink receiving layer compositions. The above mentioned surfactants are added to the top coat layer and the ink receiving layers usually in an amount from 0.01 to 1.00 $g/m^2$.

The top coat layer and the ink receiving layer can be hardened with a hardener in order to improve water resistance or dot reproduction. Examples of the hardener include aldehyde compounds such as formaldehyde and glutaraldehyde, ketone compounds such as diacetyl and chloropentanedion, bis(2-chloroethylurea), 2-hydroxy-4,6-dichloro-1,3,5-triazine, reactive halogen-containing compounds disclosed in U.S. Pat. No. 3,288,775, carbamoyl pyridinium compounds in which the pyridine ring carries a sulfate or an alkylsulfate group disclosed in U.S. Pat. Nos. 4,063,952 and 5,529,892, divinylsulfones, reactive olefin-containing compounds disclosed U.S. Pat. No. 3,635,718, N-methylol compounds disclosed in U.S. Pat. No. 2,732,316, isocyanates disclosed in U.S. Pat. No. 3,103,437, aziridine compounds disclosed in U.S. Pat. Nos. 3,017,280 and 2,983,611, carbodiimides disclosed in U.S. Pat. No. 3,100,704, epoxy compounds disclosed in U.S. Pat. No. 3,091,537, halogencarboxyaldehydes such as mucochloric acid, dioxane derivatives such as dihydroxy dioxane, and inorganic hardeners such as chromium alum, potash alum and zirconium sulfate. These hardeners can be used singly or in combination The addition amount of hardener is preferably from 0.01 to 10 weight %, more preferably from 0.1 to 5 weight %, based on the total solid content of the top coat layer or the ink receiving layer.

The top coat layer and the ink receiving layer can also comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromophthalic anhydride, urea phosphate, triphenylphosphate, glycerolmonostearate, propylene glycol monostearate, tetramethylene sulfone, and polymer latices with low Tg-value such as polyethylacrylate, polymethylacrylate, etc.

The ink receiving layer can comprise biocides. Examples of suitable biocides include (A) nonionic biocides, such as 2-bromo-4'-hydroxyacetophenone (Busan™ 90 available from Buckman Laboratories); 3,5-dimethyl tetrahydro-2H-1,3,5-thiadiazine-2-thione (Slime-Trol™ RX-28 available from Betz Paper Chem Inc.); a nonionic blend of 5-chloro-2-methyl-4-isothiazoline-3-one, 75% by weight and 2-methyl-4-isothiazolin-3-one, 25% by weight (available as Amerstat™ 250 from Drew Industrial Division; Nalcon™ 7647 from Nalco Chemical Company; Kathon™ LX from Rohm and Haas Company); and the like, as well as mixtures thereof; (B) anionic biocides, such as anionic potassium N-hydroxymethyl-N-methyl-dithiocarbamate (available as Busan™ 40 from Buckman Laboratories Inc.); an anionic blend of methylene bis-thiocyanate, 33% by weight, sodium dimethyl-dithiocarbamate, 33% by weight, and sodium ethylene bisdithiocarbamate, 33% by weight, (available as Amerstat™ 282 from Drew Industrial Division; AMA-131 from Vinings Chemical Company); sodium dichlorophene (G-4-40 available from Givaudan Corporation); and the like, as well as mixtures thereof; (C) cationic biocides, such as cationic poly(oxyethylene(dimethylamino)ethylene (dimethylamino)ethylene dichloride) (Busan™ 77 available from Buckman Laboratories Inc.); a cationic blend of bis (trichloromethyl) sulfone and a quaternary ammonium chloride (available as Slime-Trol™ RX-36 DPB865 from Betz Paper Chem. Inc.); and the like, as well as mixtures thereof. The biocide can be present in any effective amount; typically, the biocide is present in an amount of from 0.1 to 3% by weight of the coating, although the amount can be outside this range.

The ink receiving layer may further contain various conventional additives such as colorants, colored pigments, pigment dispersants, lubricants, permeating agents, fixing agents for ink dyes, UV absorbers, antioxidants, dispersing agents, antifoaming agents, leveling agents, fluidity improving agents, antiseptic agents, brightening agents, viscosity stabilizing and/or enhancing agents, pH adjusting agents, antimildew agents, antifungal agents, agents for moisture-proofing, and antistatic agents. The above-mentioned additives can be added ordinarily in a range of 0 to 10% by weight based on the total solid content of the ink receiving layer.

Any conventional coating method (for example, a curtain method, an extrusion method, a slot coating method, an air-knife method, a slide coating, a roll coating method, reverse roll coating, gravure coating, solvent extrusion, dip coating processes and a rod bar coating method) can be used to coat the ink receiving layer coating solution on the support.

The inks are generally composed of a) water, b) one or more co-solvents soluble in the water, c) one or more dyes soluble in the co-solvent, d) one or more surface-active agents, e) a pH regulator (otherwise called a buffer), f) a viscosity modifier, and g) a biocide.

The main ingredient comprises deionized water, and especially water deionized at 18 Mohm, used in percentages ranging from 50 to 90% by weight, preferably between 60 and 85% by weight.

The co-solvent comprises organic solvent(s) soluble in water, characterized by their high boiling points and low vapor pressure, examples being: glycols with low molecular weight such as ethylene glycol, diethylene glycol triethylene glycol, propylene glycol, polyethylene glycol 200 (commercially known as Carbowax™ 200), pentanediol, hexanediol, etc; glycol ethers soluble in water such as methyl-, ethyl-, butyl cellosolve, methyl-, ethyl-, butyl carbitol, etc.; glycerol, 2-pyrrolidone, N-methyl-2-pyrrolidone, N-(2-hydroxyethyl)-2-pyrrolidone. Use of one of the foregoing solvents or a mixture thereof is justified both by the need for low levels of evaporation of the ink in the region of the nozzles over even lengthy periods of inactivity of the print-head and by the need to improve the solubility of the dye in the aqueous solution The co-solvent is usually used in percentages ranging from 1 to 30% by weight and preferably between 5 and 20% by weight, guaranteeing low levels of evaporation of the ink in the region of the nozzles and not impairing performance of the ink in terms of drying time.

The dye comprises dyes with a solubility in water of more than 4% by weight selected from azo and disazo dyestuff among which are the black dyes Food Black 2, Acid Black 2, Direct Black 17, Direct Black 19, Direct Black 22, Direct Black 31, Direct Black 154, and Direct Black 168. These dyes are commonly modified with sodium sulfonate to confer water solubility. The modified dyes are almost always alkaline when dissolved in water, and they can be very effectively used. Specially useful dyes are modified with tetramethyl ammonium sulfonate.

These dyes have been used in percentages higher than 4%, preferably higher than 4.5%, and more preferably between 5% and 10% by weight.

The surfactants usable in the inks are not particularly limited. The surfactant preferably comprises non-ionic surfactants, or a mixture thereof, more preferably, non-ionic surfactants having a HLB value in the range of from 10 to 18. Particularly useful surfactants are represented by the fatty ethoxylate-alcohols or the alkyl-phenol-ethoxylate-alcohols, polyoxyalkylated ethers, ethoxylated acetilendiols, fatty acid esters of polyhydric alcohols, and mixtures thereof. Surfactants are used in percentages ranging from 0.5% to 5%, preferably between 0.5 and 4% by total weight of the ink composition.

The buffer acts as a pH regulator, keeping the pH in the desired range. Useful compounds are phosphates, borates, carbonates, sodium acetates, potassium acetates, ammonium acetates.

The viscosity modifier(s) are selected from among those compatible with ink-jet printing. The following compounds in particular may be used for this purpose: polyvinyl pyrrolidone, polyglycols of high molecular weight, amides.

Commercially available biocides are used; particularly used is a mix of semyphormal glycol and isothiazolinons (Preventol™ D6, Registered Trade Mark of Bayer AG, Germany) and 1,2 benzoisothiazolin-3-on (Proxel™, Registered Trade Mark of ICI).

Specific embodiments of the invention will now be described in detail These following examples are intended to be illustrative, and the invention is not limited to the materials, conditions, or process parameters set forth in these embodiments. All data are expressed in terms of grams per square meter, unless differently specified.

EXAMPLE 1

Sample 1 (Reference)

A receiving ink jet sheet was prepared using a 7 mil (0.18 mm) blue polyester support. A gelatin primer was coated on the front side and an anticurl gelatin layer was coated on the back side.

Three coating solutions were prepared using the components described below dissolved in water. The solutions were adjusted to pH 4.4 using sulfuric acid before coating them all at once with extrusion system at about 11 meter per minute on the front side of the aforementioned support.

The resulting coating was dried to give a multilayer ink jet receiving sheet with the following composition.

TABLE 1

| Sample | 1 |
|---|---|
| Adhesion layer | |
| Gelatin pig-skin IJ SKW | 2.020 |
| Triton ™ X-100 | 0.014 |
| Ink-receiving layer | |
| Gelatin pig-skin IJ SKW | 3.980 |
| Triton ™ X-100 | 0.040 |
| PVP K-90 | 1.740 |
| Luvitec ™ VPC55 | 5.240 |
| Alumina | 0.005 |
| Top coat layer | |
| Gelatin pig-skin IJ SKW | 0.520 |
| Zonyl ™ FSN 100 | 0.086 |
| PVP K-90 | 0.280 |
| PMMA 8 $\mu$m | 0.062 |

Triton™ X-100 is the trade name of a non-ionic surfactant of the alkyl-phenoxy-ethylene type, distributed by Union Carbide Co., Dambury, Conn., USA and corresponding to the following formula:

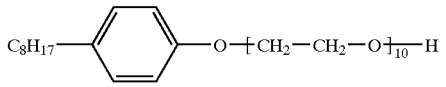

Zonyl™ FSN 100 is the trade name of a non-ionic surfactant of the per-fluoro-alkylpolyoxyethylene type, manufactured by DuPont Co., Wilmington, Del., USA and corresponding to the following formula:

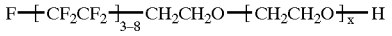

PVP-K 90 is a polyvinylpyrrolidone available from Fluka, a division of Sigma-Aldrich Co., St. Louis, Mo. USA.

Several inks comprising a high concentration of dyes were prepared for testing with the above described ink-jet receiving sheet, by using the dyes according to the following table 2.

TABLE 2

| Ink | Dye | Concentration (% w/w) |
|---|---|---|
| 1 | Carbon Black | 5.00 |
| 2 | Food Black 2 Sodium Salt | 3.50 |
| | Direct Black 168 Litium Salt | 3.50 |
| 3 | Food Black 2 Sodium Salt | 4.00 |
| | Direct Black 168 Litium Salt | 2.48 |
| 4 | Food Black Tetramethyl Ammonium Salt | 5.50 |

A sample radiological image was printed on each sample with a Ferrania LifeJet™ 400 ink jet printer (available from Ferrania Imaging Technologies, Italy, www.ferraniait.com) by using the above described inks.

The results of the tests indicated that all the inks listed in table 2 achieved an optical density higher than 3.00, but were hindered by the drawbacks summarized in the following table 3.

TABLE 3

| Ink | Result | Comment |
|---|---|---|
| 1 | Failure | Printed area cracking |
| 2 | Failure | Ejection instability |
| 3 | Failure | Fouling |
| 4 | Failure | High sticking and drying time |

The drawback of ink 4 (high sticking and drying time) was the only one that could be reduced or eliminated by an appropriate film coating, and therefore new film coatings were developed and tested by using the ink 4, as described in the following example 2.

EXAMPLE 2

Samples 2 and 3

The procedure of sample 1 was repeated by increasing the coverage of the coating solution of the ink-receiving layer and obtaining the ink jet receiving sheets according to the following table 4. The coverage of the ink-receiving layer of samples 2 and 3 was increased by 50% and 70% (by weight), respectively.

TABLE 4

| Sample | 2 | 3 |
|---|---|---|
| Adhesion layer | | |
| Gelatin pig-skin IJ SKW | 2.020 | 2.020 |
| Triton ™ X-100 | 0.014 | 0.014 |
| Ink-receiving layer | | |
| Gelatin pig-skin IJ SKW | 5.960 | 6.860 |
| Triton ™ X-100 | 0.060 | 0.069 |
| PVP K-90 | 2.606 | 2.999 |
| Luvitec ™ VPC55 | 7.847 | 9.032 |
| Alumina | 0.008 | 0.009 |
| Top coat layer | | |
| Gelatin pig-skin IJ SKW | 0.520 | 0.520 |
| Zonyl ™ FSN 100 | 0.086 | 0.086 |
| PYP K-90 | 0.280 | 0.280 |
| PMMA 8 μm | 0.062 | 0.062 |

A sample radiological image was printed on each sample with a Ferrania LifeJet™ 400 ink jet printer by using the ink 4 of example 1. The printed samples were evaluated according to the procedures described below and the results are summarized in the following table 5.

TABLE 5

| Sample | Optical Density | Drying Time | Offset | Sticking | Starry Night |
|---|---|---|---|---|---|
| 1 (Reference) | 3.15 | KO | KO | KO | OK |
| 2 (Comparison) | 3.02 | OK | KO | KO | OK |
| 3 (Comparison) | 2.91 | OK | KO | KO | OK |

Samples 2 and 3 showed an improved drying time but a still unacceptable sticking and offset effect.

Samples 4 to 11

The procedure of sample 1 was repeated by using the coating solutions of sample 3, but substituting the PMMA 8 μm of the third layer with the matt agents indicated in table 6.

TABLE 6

| Sample | Matt Agent | Coverage |
|---|---|---|
| 4 | PMMA 18 μm | 0.175 |
| 5 | PMMA 18 μm | 0.230 |
| 6 | PMMA 8 μm + | 0.080 |
| | PMMA 18 μm | 0.070 |
| 7 | PMMA 8 μm + | 0.080 |
| | PMMA 18 μm | 0.090 |
| 8 | PMMA 8 μm + | 0.080 |
| | Corn Starch 16 μm | 0.070 |
| 9 | PMMA 8 μm + | 0.080 |
| | Corn Starch 16 μm | 0.110 |
| 10 | Corn Starch 16 μm | 0.140 |
| 11 | Corn Starch 16 μm | 0.220 |

A sample radiological image was printed on each sample with a Ferrania LifeJet™ 400 ink jet printer by using the ink 4 of example 1. The printed samples were evaluated according to the procedures described below and the results are summarized in the following table 7.

TABLE 7

| Sample | Optical Density | Drying Time | Offset | Sticking | Starry Night |
|---|---|---|---|---|---|
| 4 (Comparison) | 2.79 | OK | OK | OK | KO |
| 5 (Comparison) | 2.73 | OK | OK | OK | KO |
| 6 (Comparison) | 2.88 | OK | OK | OK | KO |
| 7 (Comparison) | 2.80 | OK | OK | OK | KO |
| 8 (Comparison) | 3.01 | OK | KO | KO | OK |
| 9 (Comparison) | 3.01 | OK | KO | KO | OK |
| 10 (Comparison) | 3.11 | OK | KO | KO | OK |
| 11 (Comparison) | 3.15 | OK | KO | KO | OK |

The set of samples 4 to 7 showed good results in terms of drying time and sticking but the optical density values worsened and the presence of matt particles having a size higher than 10 μm showed a severe problem of "starry night" (expression used to define the presence of a high number of white dots within the black printed areas). The set of samples 8 to 11 suprisingly showed that the optical density values returned to good values and the starry night effect disappeared when using corn starch matt agent either alone or in combination with PMMA lower than 10 μm. Unfortunately, the sticking of samples 8 to 11 was found unacceptable.

Samples 12 to 17

The procedure of sample 1 was repeated by using the coating solutions of sample 2, but removing the PVP K-90 from the third layer and modifying the amount and kind of matting agent as described in the following table 8.

TABLE 8

| Sample | Matt Agent | Coverage |
|---|---|---|
| 12 | PMMA 18 μm | 0.145 |
| 13 | PMMA 18 μm + | 0.036 |
| | Corn Starch 16 μm | 0.197 |
| 14 | PMMA 18 μm + | 0.037 |
| | PMMA 8 μm | 0.109 |
| 15 | PMMA 8 μm + | 0.037 |
| | Corn Starch 16 μm | 0.197 |
| 16 | Corn Starch 16 μm | 0.261 |
| 17 | Corn Starch 16 μm | 0.326 |

A sample radiological image was printed on each sample with a Ferrania LifeJet™ 400 ink jet printer by using the ink 4 of example 1. The printed samples were evaluated according to the procedures described below and the results are summarized in the following table 9.

TABLE 9

| Sample | Optical Density | Drying Time | Offset | Sticking | Starry Night |
|---|---|---|---|---|---|
| 12 (Comparison) | 3.08 | OK | OK | OK | KO |
| 13 (Comparison) | 3.22 | OK | OK | OK | KO |
| 14 (Comparison) | 3.20 | OK | OK | OK | KO |
| 15 (Invention) | 3.25 | OK | OK | OK | OK |
| 16 (Invention) | 3.24 | OK | OK | OK | OK |
| 17 (Invention) | 3.22 | OK | OK | OK | OK |

The set of samples 15 to 17 surprisingly showed increased optical density values (in particular when compared with samples 8 to 11) and good results either in terms of drying time, sticking and starry night.

Evaluation Tests

All tests are conducted at 23° C. (±1° C.) and 50% Relative Humidity (+/−5%).

Optical Density

The printed sample was a pattern of ten rectangles having different density from 0% to 100% with a step between rectangles of 10%. The density was measured with a manual densitometer X-Rite™ 310 (Status M) and the value measured at 100% density was reported.

Drying Time

The printed sample was a rectangular bar of 1×25 cm printed at 100% optical density (all RGB values set to 0). Immediately after the end of printing, a paper sheet was placed on the printed image and twice roiled with a two kilogram roll. Drying time was judged OK when the optical density of the ink transferred from the printed sample to the paper sheet was lower than 0.03 (measured with a manual densitometer X-Rite™ 310 Status A).

Sticking/Offset

The printed sample was a pattern of five rectangles, each having four steps printed at 70–80–90–100% optical density, respectively. Each rectangle was printed in one minute for a total printing time of five minutes. Sticking and offset were evaluated after contacting the printed image with a paper or plastic foil and pressing the foil with a weight of 750 grams for three hours. The sticking was judged OK when no visible damages were present on the image after detachment of the paper or plastic foil. The offset was judged OK when the optical density of the ink transferred from the printed sample to the paper sheet was lower than 0.03 (measured with a manual densitometer X-Rite™ 310 (Status A).

What is claimed is:

1. An ink receiving sheet comprising a support, at least one ink receiving layer and a top coat layer, characterized in that said ink receiving layer has a total coverage weight of at least 12 g/m$^2$, said top coat layer comprises a hydrophilic binder and a corn starch matting agent, and said top coat layer is free of vinyl polymeric compounds.

2. The ink receiving sheet of claim 1 characterized in that said receiving layer has a total coverage weight of at least 15 g/m$^2$.

3. The ink receiving sheet of claim 1 characterized in that said receiving layer comprises a hydrophylic binder and at least one vinyl polymeric compound.

4. The ink receiving sheet of claim 3 characterized in that said receiving layer has a binder total coverage weight of at least 4.5 g/m$^2$ and a vinyl polymeric compound total coverage weight of at least 7.5 g/m$^2$.

5. The ink receiving sheet of claim 3 characterized in that said receiving layer has a binder total coverage weight of at least 5.5 g/m$^2$ and a vinyl polymeric compound total coverage weight of at least 9.5 g/m$^2$.

6. The ink receiving sheet of claim 3 characterized in that said vinyl polymeric compound is selected from the group consisting of polymers and copolymers of vinyl alcohols, vinyl acetates, vinylpyrrolidones, vinyllactams, vinylimidazoles, and vinylpiperidones.

7. The ink receiving sheet of claim 1 characterized in that said binder is selected from the group consisting of acidified starch, ethered starch, polyalkylene glycols, cellulose derivatives, gelatin, gelatin derivatives, carrageenan, dextran, dextrin, gum arabic, casein, pectin, albumin, collagen derivatives, collodion, agar-agar, maleic acid resin.

8. The ink receiving sheet of claim 1 characterized in that said binder is selected from the group consisting of gelatin, gelatin derivatives, dextran, and binary or ternary mixtures thereof.

9. The ink receiving sheet of claim 1 wherein the support is a transparent polymeric film sheet.

10. The ink receiving sheet of claim 9 wherein an ink-jet image is permanently fixed to the receiving sheet and the ink-jet image has an optical density greater than 3.00.

* * * * *